US005375425A

United States Patent [19]

Cobb

[11] Patent Number: 5,375,425

[45] Date of Patent: Dec. 27, 1994

[54] COLLECTION METHOD FOR GASEOUS OR LIQUID PHASE MATERIALS

[76] Inventor: Douglas A. Cobb, Box 128, Great Falls, Va. 22066

[21] Appl. No.: 981,271

[22] Filed: Nov. 25, 1992

[51] Int. Cl.[5] ..... F25B 45/00

[52] U.S. Cl. ..... 62/77; 62/292; 62/55.5

[58] Field of Search ..... 62/77, 292, 149, 55.5, 62/50.2, 11, 49.1, 49.2

[56] References Cited

U.S. PATENT DOCUMENTS

| | | | |
|---|---|---|---|
| 4,133,663 | 1/1979 | Skinner | 62/18 |
| 4,150,494 | 4/1979 | Rothchild | 34/27 |
| 4,350,018 | 9/1982 | Frank et al. | 62/54 |
| 4,424,680 | 1/1984 | Rothchild | 62/48 |
| 4,761,961 | 8/1988 | Marx | 62/50.2 |
| 4,766,733 | 8/1988 | Schuderi | 62/77 |
| 4,996,848 | 3/1991 | Nelson et al. | 62/77 |
| 5,101,637 | 4/1992 | Daily | 62/292 |

*Primary Examiner*—John M. Sollecito

*Attorney, Agent, or Firm*—Whitham, Curtis, Whitham & McGinn

[57] ABSTRACT

Removal of refrigerant from a closed refrigeration system is achieved without pumping by developing a deep (e.g. 10 to 20 inches of mercury) partial vacuum in a collection vessel by reducing the temperature thereof. The partial vacuum is self-sustaining through the condensation and solidification of collected fluid at cryogenic temperatures and the reduction of vapor pressures thereof. The cryogenic material is preferably applied to the collection vessel by means of a bucket-shaped foam core in which the collection vessel is placed. Grooves formed on the interior of the core provide spacing and frictional engagement with the collection vessel while forming voids for maintaining a cryogenic material in contact with the collection vessel. The safety of a collection system employing the invention is enhanced since the amount of fluid collected can be regulated by the amount of cryogenic material used to condense and solidify the fluid.

9 Claims, 1 Drawing Sheet

COLLECTION METHOD FOR GASEOUS OR LIQUID PHASE MATERIALS

BACKGROUND OF THE INVENTION

CROSS-REFERENCE TO RELATED APPLICATIONS

This application is related to concurrently filed U.S. patent application Ser. No. 07/981,253 now U.S. Pat. No. 5,333,461 entitled LIQUID TRAP FOR GASEOUS OR LIQUID PHASE MATERIALS, by Douglas A. Cobb, which is fully incorporated by reference herein.

FIELD OF THE INVENTION

The present invention generally relates to the collection of gaseous or liquid phase materials and, more particularly, to a collection vessel for collecting refrigerant fluids when removed from refrigeration or air-conditioning systems while preventing venting of the refrigerant materials to the atmosphere.

DESCRIPTION OF THE PRIOR ART

Refrigeration systems, including heat pumps and air-conditioning systems have been in widespread use in the United States and other countries for many years. These systems, which provide for heat transfer between heat exchangers by alternately compressing (e.g. condensing) and decompressing (e.g. evaporating) a refrigerant fluid, are generally quite reliable and will operate with minimal service for periods of several years at a time. However, when service is required, the entire system must have the refrigerant removed before service can be performed.

In the past, it was often the practice to simply vent the refrigerant to the atmosphere, which could be done in a very short time by simply cutting or otherwise opening a tube in which the refrigerant was carried. More recently, however, it has been discovered that this practice represents a substantial environmental hazard. Specifically, most common refrigerant materials, notably chlorinated fluorocarbons (CFC's) such as Freon TM, are believed to catalyze the destruction of ozone molecules in the atmosphere and may otherwise react with other atmospheric gases, as well.

Ozone concentrations in the atmosphere are of particular concern since ozone reduces the transmission of the ultraviolet (UV) portion of sunlight to the earth's surface and depletion of ozone has thus been linked to increased incidence of skin cancer in humans in recent years. The action of CFC's is particularly severe since it appears to catalyze reactions of ozone rather than directly reacting therewith. These CFC molecules are generally quite stable and it has been theorized that a single molecule of a CFC propellant or refrigerant may catalyze the decomposition of ten thousand molecules of ozone or perhaps many times that number.

CFC materials have also been used as propellants in aerosol dispensers. Such use is now forbidden in the United States and some other countries, but use as propellants still continues in many parts of the world. Therefore, in circumstances where collection of CFC's is possible, it is critically important that collection be complete and venting of CFC's into the atmosphere eliminated.

Accordingly, in recent years, numerous arrangements have been proposed and used in practice to collect refrigerant materials from refrigeration systems.

However, these systems often allow a percentage of the refrigerant to escape into the atmosphere. Since some refrigeration systems are quite large, even small percentages of escaping refrigerant can represent quite substantial amounts of refrigerant material. Also, for some small systems such as in a home refrigerator or an automobile, the percentage of refrigerant which escapes is often much larger since the tubes for connection of any refrigerant collection system (and from which refrigerant cannot be collected in prior arrangements) represent a comparatively large volume.

Further, these collection arrangements are inherently quite slow when used properly to minimize escape of refrigerant, causing a 300% increase in the time required for performing service on a refrigeration system. For example, in servicing of an air conditioning system, a collection system is typically connected to the refrigeration system at service valves provided therein. When these service valves are opened, the refrigerant, if above atmospheric pressure, will flow spontaneously to the collection vessel. Thereafter, pumping of the refrigerant is done to pressurize the refrigerant in the collection vessel and to draw a partial vacuum in the refrigeration system in order to extract the refrigerant. This pumping process is slow and requires specially designed pumps since in the latter stages of the operation, the pump is operating to pump material from a substantial vacuum pressure to a relatively high expansion pressure. A fairly high degree of vacuum is required by regulation at the present time (10 inches of mercury, soon to be increased to 20 inches of mercury). Nevertheless, some refrigerant remains in the refrigeration system and in the tubes between the pump and the collection vessel. This refrigerant is then lost to the atmosphere.

Additionally, the collection vessels must not be overfilled since the degree to which a collection vessel may be safely filled is a function of the pressures it is designed to withstand. Therefore, refrigerant in overfilled collection vessels will not be purchased for recycling since overfilled vessels present the danger of an explosion. Thus, collection of refrigerant from a large system requires monitoring of the amount of collected material by trained personnel and periodic stopping of the collection process and substitution of collection vessels. Additional refrigerant is lost to the atmosphere at each change of collection vessels since they must be disconnected from the collection system while the connection tubing is filled with pressurized refrigerant.

Air-conditioning systems are also known which operate at a vacuum using so-called Freon R 113 TM, which is a liquid at room temperature and atmospheric pressure. Collection of refrigerant from this type of system relies on passing gases, containing the refrigerant, in the vapor state, from a tank into a water-cooled heat exchanger in which any vapor phase refrigerant is theoretically condensed and flows back under the influence of gravity to the tank while uncondensed gases are vented. However, such flow is impeded by the gas flow and a portion of the refrigerant may again be evaporated. Therefore, it is estimated that the portion of refrigerant which escapes to the atmosphere may be as high as 10% to 20% of the portion collected by this apparatus.

This system, which relies on condensation of the refrigerant at a temperature only slightly below the boiling point of the refrigerant, also requires several hours to process the contents of a moderate sized refrigeration system. Such an extended period of time, during which the system must be operated by skilled personnel increases the cost of service to the refrigeration system. Further, it reduces the number of units which can be serviced by such personnel by about two-thirds compared to the prior practice (e.g. two units instead of six units per day) when the refrigerant was merely vented to the atmosphere. Therefore, there is a substantial pecuniary incentive to use the apparatus improperly, resulting in increased amounts of refrigerant released into the atmosphere. Such improper use of the apparatus and the deleterious effects of such improper use are the direct result of reliance on a heat exchanger which is open to the atmosphere to condense all refrigerant in the gases passed therethrough. Clearly, if gases are passed too rapidly through the heat exchanger, complete condensation cannot take place. Further, if the flow rate of such gases is further increased, the flow of gases may counteract the counter flow of condensed refrigerant or even cause liquified refrigerant to be re-evaporated and/or ejected from the heat exchanger. At the present time, there are no feasible or effective safeguards against improper operation of this type of collection apparatus and only a separate detector of the refrigerant material would be able to determine whether or not refrigerant was, in fact, being vented. The provision of such a detector would be of marginal value since the collection apparatus, even if properly operated, is incapable of collecting all of the refrigerant. The amount of refrigerant allowed to escape might be reduced to low concentration levels by low flow rate and yet permit a substantial quantity of refrigerant to escape over a period of time. In short, the present state of the art imposes a trade-off between the rate of refrigerant collection and the amount of refrigerant which is allowed to escape into the atmosphere. The limitations of current collection equipment effectively encourage faster collection rates with the result of greatly increased amounts of released refrigerant.

It has been found by the inventor that the above described apparatus can be made to function more efficiently by reducing the temperature at which the heat exchanger is made to operate. However, complete collection of refrigerant is still not achieved. Other low temperature and cryogenic gas collection arrangements are also known in the art such as are disclosed in U.S. Pat. Nos. 4,150,494 and 4,424,680 to Rothschild. However, a major concern in the operation of such systems is the prevention of freezing of the condensible gas as it is introduced into the vicinity of the cryogenic material. Such freezing may entirely block flow of the condensible gas and halt the collection process. The only alternative in such a case is to substitute collection apparatus and to continue the process with the substituted apparatus; a time consuming and apparatus intensive option which also causes some release of material to be collected. Accordingly, the rate of collection of gases and the proximity of the collected gas and the cryogenic material, such as liquid nitrogen, is carefully controlled in much the same manner as with the heat exchanging condenser in the system described above. In fact, arrangements such as passing the collected gases over the surface of the cryogenic material (as in Rothschild U.S. Pat. No. 4,150,494) or spraying a liquid cryogenic material into a stream of gas to be collected (as in Rothschild U.S. Pat. No. 4,424,680) are merely different forms of heat exchanging condensers. Either of these arrangements only improve upon the efficiency of the above described apparatus by virtue of the lower available temperature at which the heat exchange takes place. Both rely on regulation of the flow rate of the gas to be collected and neither provides any selective barrier to the escape of gases to be collected or inherent safeguard against the misuse of the collection apparatus.

As further background, at the present time, refrigerants are collected in the field using portable tanks which are filled with air. The refrigerant is mixed with the atmosphere in the container as the refrigerant is pumped or displaced from the refrigeration system. Apparatus used to transfer refrigerant from the collection containers to a larger tank, either in the field or at a refrigerant recycling facility presents a further opportunity for loss of refrigerant to the atmosphere. Therefore, there are several points in the present collection process where refrigerant is likely to be vented to the atmosphere.

SUMMARY OF THE INVENTION

It is therefore an object of the present invention to provide a collection arrangement which creates a deep vacuum in the collection vessel for collection of CFC's without the assistance of a vacuum pump.

It is another object of the invention to provide a collection vessel which can be transported and used with increased safety and convenience and which is relatively immune from misuse.

In order to accomplish these and other objects of the invention, a collection vessel is provided, comprising, in combination, an inner collection vessel capable of withstanding a predetermined vacuum pressure, and a core surrounding a lower portion of the inner collection vessel and spaced therefrom to form a container for cryogenic material in contact with the inner collection vessel.

In accordance with another aspect of the invention, a bucket-shaped member is provided for enclosing at least a lower portion of an inner collection vessel, including an arrangement for forming voids around the periphery of an inner vessel and for containing a liquid cryogenic material.

In accordance with a further aspect of the invention, a method of collecting a fluid is provided including the steps of placing the interior of a collection vessel in communication with a fluid to be collected and developing a partial vacuum in said collection vessel by removing heat therefrom.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
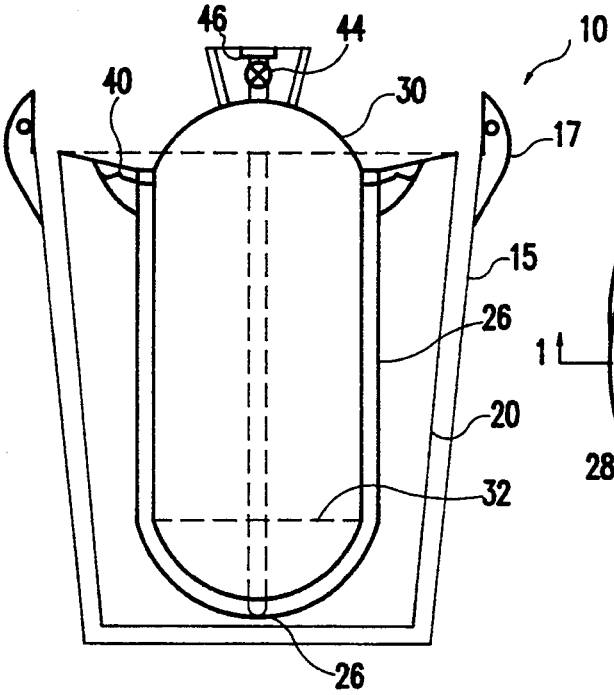
FIG. 1 is a cross-sectional view of a collection vessel in accordance with the invention.
Figure 2:
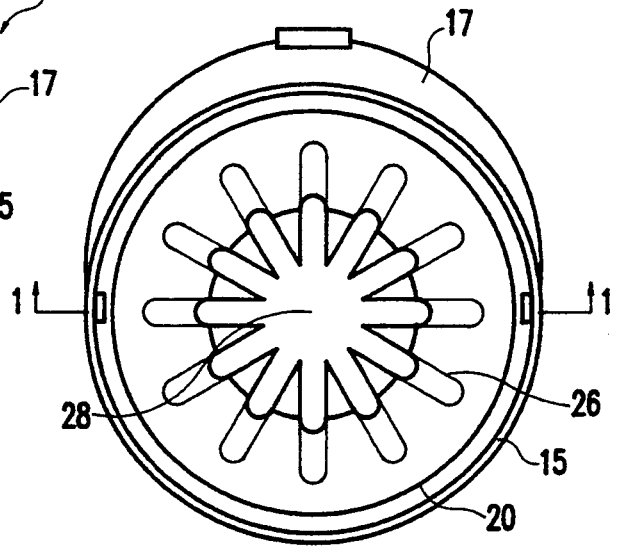
FIG. 2 is a partially cut-away top view of the collection vessel of FIG. 1.

Referring now to the drawings, and more particularly to FIGS. 1 and 2, there is shown a collection vessel 10 in accordance with the invention. The collection vessel includes a bucket-shaped core 20 and an inner collection vessel 30. Preferably, the outer portion of the core 20 is shaped to be received within a commercially available bucket 15 of metal or plastic which then provides mechanical protection for the core and convenience of transportation by means of a handle 17 commonly attached to such buckets.

The overall shape of the inner portion 30 of the collection vessel is not particularly critical to the practice of the invention as long as it is designed to withstand vacuums in excess of 20 inches of mercury (or the vacuum pressures currently required by regulation) and internal pressures of up to several atmospheres. The material of which the container is made is similarly not critical to the practice of the invention as long as the above-noted vacuum pressure can be maintained at cryogenic temperatures. However, aluminum is preferred since it does not become brittle at cryogenic temperatures. Aluminum also provides somewhat enhanced heat transfer and conduction characteristics in comparison with other materials.

A network of webs 32 is optionally provided within the inner collection vessel 30 and indicated by dashed lines in FIG. 1. The configuration of this network of webs is also not critical to the practice of the invention but should be generally open (e.g. at the top and bottom, as shown in FIG. 1) to allow free fluid circulation within the inner collection vessel 30 and can be advantageously arranged (e.g. radially) to provide structural support to the walls of the inner vessel 30 over the above-noted range of vacuum levels and pressures. This web should preferably be made of relatively thin sheet material to occupy as little volume as possible, consistent with the required reinforcement of the vessel. The vessel is preferably closed with a valve 44 and includes a connection fitting 46, both of which will be more fully discussed below.

Referring to both FIG. 1 and FIG. 2, core 20 is preferably bucket-shaped with a closed bottom and an inner cylindrical recess sized to receive the inner vessel 30. Recesses in the inner surface of core 20 are preferably formed as grooves 26 extending vertically along the sides of inner vessel 30, forming voids between the remainder of the core 20 and the inner vessel 30. These grooves (some of which are omitted for clarity in FIG. 1) are preferably carried across the bottom of the inner recess so that all grooves are in communication with each other in a central region 28 at the bottom of the inner surface so that an equal level of cryogenic material 40 will be present in all grooves. The number of such grooves and their dimension about the circumference of inner vessel 30 should be such as to allow liquid cryogenic material to contact a major portion of the surface of inner vessel 30. Grooves 26 may be molded, machined or otherwise cut into the inner surface of core 20 to establish a predetermined volume of the voids.

Alternatively, spacers may be provided between the sides of a generally cylindrical recess to engage the inner vessel 30 about the periphery thereof but are not preferred as being more susceptible to damage and are less accurate in maintaining a predetermined volume of the voids, as will be discussed in greater detail below. In either case, the inner conformation of core 20 should allow for fluid circulation in the vicinity of the lower portions of core 20 so that an equal level of liquid cryogenic material will be maintained around inner vessel 30 as in the preferred embodiment of the invention.

The material of which core 20 is fabricated is also not particularly critical to the practice of the invention as long as it is thermally insulative and retains some degree of resiliency at cryogenic temperatures. Expanded polystyrene (EPS) is a preferred material meeting these requirements. It is preferred that the inner surface of core 20 be dimensioned to provide a slight interference fit over inner vessel 30 so as to be retained thereon by friction, even when the voids 26 between the core 20 and the inner vessel 30 are filled with liquid cryogenic material as indicated at 40 of FIG. 1.

For collection of refrigerant, it is preferred that the inner collection vessel be pumped down to the partial vacuum required for refrigerant collection although this procedure is principally for the purpose of minimizing contamination of the collected refrigerant. Such pumping will, however, assure that no significant amount of material will remain in the inner vessel 30 which has a vapor pressure at near-cryogenic temperatures which would impede the collection process. Also, such a partial vacuum can be maintained until the collection vessel is used and will speed the starting of the collection process, as will become apparent from the following explanation of the principles of the invention.

The use of partial vacuums for the collection of materials is known in some fields such as for the collection of biological specimens. However, as the collection vessel is filled, vacuum is reduced. The invention, in contrast, provides for a sustainable deep vacuum by condensing and solidifying collected gases and liquids as they are collected by heat exchange with a liquid cryogenic material, such as liquid nitrogen, placed in the voids 26 of core 20, as indicated at 40 of FIG. 1. In addition to the reduction of volume of the collected materials, the reduction of temperature also reduces the vapor pressure of the contents of the collection tank. Therefore, a deep vacuum can be achieved and maintained while the inner collection tank 30 is filled. As applied to refrigerant collection, this concept, as embodied in the present invention, has several distinct advantages unavailable in the prior art.

First, since the vacuum is self-sustaining until a significant fraction of the volume of the inner vessel is filled, no mechanical pumping is required. Therefore equipment which must be transported to the collection site is limited to a connection tube and the collection vessel 10, itself (once charged with the cryogenic material).

Second, filling of the inner collection vessel is limited by two mechanisms: the amount of liquid nitrogen available for condensing and solidifying the material and, to a limited extent, the filling of the container itself, reducing the collection volume. Thus, the collection is self-limiting and the collection vessels cannot be overfilled if the volume of cryogenic material is suitably limited. In other words, if the volume of cryogenic material is limited to an amount only sufficient to solidify the amount of refrigerant which can be safely contained within the collection vessel, the vacuum will be self-sustaining only for collection of that amount of refrigerant. As a practical matter, the mass of cryogenic material contained within the core 20 should bear the same proportion to the mass of refrigerant to be collected as the heat of evaporation of the cryogenic material bears to the heat of evaporation of the refrigerant, increased by the product of the difference between the evaporation temperature of the refrigerant and the ambient temperature, the specific heat of the refrigerant and the mass of the refrigerant. A slight correction should also be made to compensate for heat gained by the system from the surrounding atmosphere during collection. This amount can be rigorously computed but, for practical purposes, a nominal weight of liquid nitrogen may be determined empirically for collection of 90% to 95% of vessel capacity. If, as is preferred, voids 26 have a total volume which is equal to the volume of cryogenic material needed to collect the allowable capacity of the collection vessel without overfilling, a volume slightly less than the safe capacity can be collected with a high degree of repeatability. This advantage extends to be possible avoidance of the need for automatic weighing equipment now used to control the operation of valves in order to prevent overfilling, as is now common practice in the art.

Third, as vessels are filled while vacuum is self-sustaining, as may be monitored by the presence of remaining cryogenic material, the available vacuum may be used to purge connections and tubes even when several collection vessels must be used in sequence to collect refrigerant from a large system.

Fourth, there is no mixing of other materials with the collected refrigerant, assuming, as is preferred, that the inner collection vessel is evacuated prior to collection. As is known, common refrigerants have affinity for most common lubricants and may even be contaminated by lubricants in a pump. Since no pumping is required in accordance with the invention, there is no source of that or any other contaminants other than in the ambient atmosphere as lines are purged. Even contamination from this source can be closely limited as will be discussed below.

Fifth, since the vacuum pressure which can be self-sustained in dependence only on extremely low vapor pressure of materials at cryogenic temperatures, the rate of collection is limited only by the rate of heat exchange and not on other factors such as pump displacement. Therefore, with high thermal conductivity of the inner vessel 30 and, to a lesser degree, web materials and design, collection rate can be accelerated to rates beyond those that can be achieved by pumping.

Sixth, the collection system in accordance with the invention is closed at all times during collection, even when the collection process may be halted or interrupted. Further, when the collection system must be opened, such as for substitution of collection vessels, there is no point in the system which cannot be purged, either of air or of refrigerant, since the source of vacuum is the collection vessel itself. Therefore, the system can be used for collection of refrigerant with no inherent loss of refrigerant or contamination thereof.

Seventh, since heat exchange relies on heat conduction through the material of the web 32 and the body 30 of the collection vessel, there is typically enough thermal resistance that freezing at the inlet to the collection vessel to prevent blockage thereof. Therefore, each vessel can be used to its fullest allowable collection volume. In this regard, it should be noted that if a partially filled collection vessel has been allowed to return to ambient temperature, the same amount of cryogenic material to collect a safe amount of refrigerant should again be charged into the core since the previously collected material must again be solidified before further collection will proceed. Although this may take additional time, it also may be a safety feature and a convenience since partially filled collection vessels may be used in subsequent collection operations and still cannot be overfilled. In other words, the contents of a partially filled collection vessel need not be determined if at ambient temperature.

Eighth, since there is no contamination of the refrigerant during collection, the collected refrigerant, which will usually have returned to near ambient temperature during service of the refrigeration system, may be reinstalled in the system, again without the use of pumps. For example, a collection vessel in accordance with the invention, but dedicated to collection of ambient atmospheric gases, could be used to develop a deep vacuum to draw air and contaminant gases from the refrigeration system after service. Then the collection vessel containing the collected refrigerant could be attached and the refrigerant allowed to flow back into the refrigeration system under the influence of pressure developed by the temperature rise of the collection vessel. Then the system could be "topped up" to specification pressure with high pressure refrigerant from a small tank. This latter advantage is not limited to flexibility in service procedures but extends to reducing the amount of refrigerant used and, hence, the demand for newly manufactured refrigerant, the avoidance of the need for recycling of the refrigerant to remove contaminants in the majority of cases (both of which would reduce the cost of servicing a refrigeration system), and a reduction in the amount of equipment and containers of refrigerant which must be transported to and from the site where service is conducted.

Figure 3:
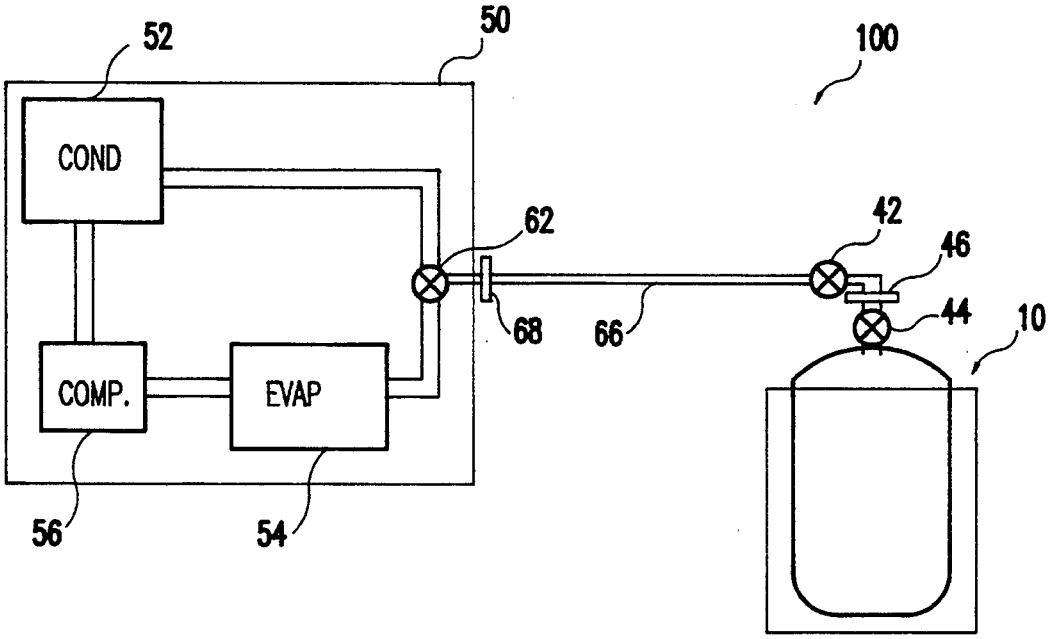
FIG. 3 is a schematic diagram of a gas collection system utilizing the collection vessel of FIG. 1.

To more fully convey an appreciation for these advantages, use of a refrigerant collection system 100 including the collection vessel 10 in accordance with the invention will now be explained with reference to FIG. 3. In FIG. 3, refrigeration system 50 is depicted schematically as a condenser 52, compressor 56 and evaporator 54, connected in a closed loop system. When refrigerant is to be collected from system 50, it is only necessary to connect collection vessel 10 to the refrigeration system 50 at service fitting 68 provided therein in combination with service valve 62. This connection is preferably made with a flexible tubing connection 66 which preferably includes a portion of connection 46 and a further valve 42, preferably positioned as closely as possible to the connection 46. Thus, prior to making connection 46, valve 62 can be opened with valve 42 closed. Then valve 42 can be cracked slightly and the end of the tube monitored for the presence of refrigerant when refrigerant is present, tube 66 will have been purged of ambient air and thus is free of contaminant gases. Then connection 46 can be completed.

Once connection 46 is made, the core 20 can be filled with liquid cryogenic material and the collection process can begin. If a partial vacuum has already been drawn on the collection vessel as discussed, it is not necessary for significant heat exchange to take place before collection starts since no significant cooling of the collection vessel is initially necessary to establish the partial vacuum. In such a case, when valve 62, 42 and 44 are opened, refrigerant will be collected until vacuum is equalized throughout the collection vessel and the refrigeration system 50 and will then proceed whenever condensation and solidification due to heat exchange begins. However, cooling of the inner collection vessel 30 is extremely rapid and the development of a significant vacuum is nearly instantaneous. Collection will then continue as long as the cryogenic material is available for heat exchange with refrigerant within the vessel.

In low pressure refrigeration systems, however, such purging of tube 66 is not possible due to the atmospheric pressure therein which is higher than the system pressure. In such systems, contamination is not critical since they normally include a purge unit to extract so-called non-compressible gas (NCG) contaminants during operation. Such purge units are necessary to avoid atmospheric contaminant gases. In any event, however, the volume of contaminant gases collected will be limited to the volume of tube 66.

It should be noted that the collection process can be stopped and restarted at any point by regulation of the presence of cryogenic material. For example, when an initial charge of cryogenic material in the core 20 is exhausted, the collection vessel could be weighed to determine the amount of refrigerant collected. Additional cryogenic material could then be charged into the core 20 to collect additional refrigerant, if desired. Alternatively, valves 62 or 42 could be closed and additional cryogenic material added to develop vacuum to purge the connection tubing 66 and/or tubing adjacent to coupling 46 with the same or a different collection vessel. Incidentally, valve 46 is provided to avoid contamination of refrigerant by ambient atmosphere in tube 66 as would be the case if attachment was made only at coupling 68. If valve 42 is provided, it can be closed and connection 46 broken to purge tube 66. The connection 46 can easily be placed in sufficient proximity to connection 44 and the volume thereof suitably limited that no significant contamination of the refrigerant will occur. At the same time, such purging of refrigerant from this small volume limits the venting of refrigerant to the atmosphere. Upon connection of a collection vessel, the same volume can be purged of air in the same manner as noted above in regard to tube 66. Filled collection vessels can then be allowed to return to ambient temperature in order to develop pressure for returning refrigerant to the refrigeration system.

In view of the foregoing, it is seen that the invention provides a collection vessel, system and methodology which is greatly simplified from the prior art and may be practiced with enhanced safety and speed and with no inherent release of refrigerant into the atmosphere. It is also to be understood that while the inclusion of one or more web members is preferred for maximum rate of heat transfer and vessel strength, they are not, in fact, necessary to the successful practice of the invention. The invention may be practiced and retrofit onto existing vessels, assuming such vessels are made of materials which can withstand cryogenic temperatures, simply by placing a core 20 around the same and charging the core with a cryogenic liquid as described above. Therefore the invention encompasses not only the combination collection vessel 10 and the methodology of its use but the bucket-shaped core member 20, itself, which will provide more rapid heat transfer to vessel 30.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A method of collecting a fluid including the steps of placing the interior of a collection vessel in communication with a fluid to be collected, determining an amount of liquid cryogenic material to be applied to said collection vessel based on a capacity of said collection vessel, a mass of the fluid, the specific heat, and evaporation temperature of the fluid, and developing a partial vacuum in said collection vessel by applying an amount of cryogenic material which is not greater than said amount determined in said determining step to an exterior of said collection vessel to remove heat therefrom whereby the amount of fluid is limited to an amount which can be safely contained within the collection vessel at a predetermined temperature.

2. A method as recited in claim 1, wherein said fluid is to be collected from a closed refrigeration system and including the further step of connecting a tube between said closed refrigeration system and said collection vessel.

3. A method as recited in claim 2, including the further step of collecting said fluid from at least a portion of said tube.

4. A method as recited in claim 1, wherein said step of developing a partial vacuum includes applying a cryogenic material to said collection vessel and including the further step of controlling the mass of fluid collected in proportion to an amount of said cryogenic material applied to said collection vessel.

5. A method as recited in claim 1, wherein said step of developing a partial vacuum includes the step of applying a cryogenic material to an exterior of said collection vessel.

6. A method as recited in claim 5, wherein said step of applying a cryogenic material to an exterior of said collection vessel includes the step of pouring a liquid cryogenic material into voids between said collection vessel and a core surrounding said collection vessel.

7. A method as recited in claim 6, including the further step of determining an amount of said liquid cryogenic material to be applied to said collection vessel based on an amount of said fluid to be collected.

8. A method as recited in claim 7, wherein said voids are sized to contain said amount of liquid cryogenic material determined by said determining step.

9. A method as recited in claim 5, wherein said applying step includes applying liquid nitrogen to said collection vessel.

* * * * *